US009468952B2

(12) United States Patent
Huang

(10) Patent No.: US 9,468,952 B2
(45) Date of Patent: Oct. 18, 2016

(54) AUTOMATIC CLEANING DEVICE

(71) Applicant: CHAN LI MACHINERY CO., LTD., Taoyuan (TW)

(72) Inventor: Chang-Chou Huang, Taoyuan (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 634 days.

(21) Appl. No.: 13/869,219

(22) Filed: Apr. 24, 2013

(65) Prior Publication Data

US 2014/0201945 A1 Jul. 24, 2014

(30) Foreign Application Priority Data

Jan. 18, 2013 (TW) ..... 102101959 A

(51) Int. Cl.

| | |
|---|---|
| ***A47L 5/14*** | (2006.01) |
| ***B08B 5/02*** | (2006.01) |
| ***B08B 5/04*** | (2006.01) |
| ***B08B 9/02*** | (2006.01) |
| ***D21F 3/10*** | (2006.01) |
| ***D21F 7/00*** | (2006.01) |

(52) U.S. Cl.

CPC ..... *B08B 5/023* (2013.01); *B08B 5/043* (2013.01); *B08B 9/021* (2013.01); *D21F 3/10* (2013.01); *D21F 7/00* (2013.01); *A47L 5/14* (2013.01)

(58) Field of Classification Search

CPC ..... A47L 5/14; A47L 5/38; B08B 5/023; B08B 5/043; B08B 9/021; D21F 3/10; D21F 7/00

USPC ..... 15/301, 304, 312.1, 345

IPC ..... A47L 5/14

See application file for complete search history.

(56) References Cited

U.S. PATENT DOCUMENTS

| | | | | | |
|---|---|---|---|---|---|
| 4,674,925 | A * | 6/1987 | Thornton | B23B 39/167 | 408/1 R |
| 5,465,639 | A * | 11/1995 | Senbokuya | B26D 1/205 | 83/34 |
| 5,964,960 | A * | 10/1999 | Boeck | D21G 3/00 | 134/103.2 |
| 6,592,721 | B1 * | 7/2003 | Anderson | D21F 3/10 | 162/274 |

FOREIGN PATENT DOCUMENTS

| | | | |
|---|---|---|---|
| CN | 2601747 | Y | 2/2004 |
| CN | 201161350 | Y | 12/2008 |
| CN | 202380228 | U | 8/2012 |
| JP | 2008-62122 | A | 3/2008 |
| TW | 200812714 | | 3/2008 |

* cited by examiner

*Primary Examiner* — David Redding

(74) *Attorney, Agent, or Firm* — Rosenberg, Klein & Lee

(57) ABSTRACT

The present invention provides an automatic cleaning device, particularly to an automatic cleaning device for cleaning suction holes of a roller. In this case, the roller comprises a plurality of suction holes, and the automatic cleaning device comprises at least one blowing device. The blowing device is provided alongside the face of the roller so as to blow toward the suction holes of the rotating roller. By the use of the blowing device, not only blowing dust or dirt in the suction holes of the roller away so as to keep the suction holes clean and ventilated all the time, but also cleaning the suction holes by air blowing without the need for shutting down the roller so as to avoid the shutdown of roller to effect the production efficiency of product.

4 Claims, 8 Drawing Sheets

AUTOMATIC CLEANING DEVICE

FIELD OF THE INVENTION

The present invention is related to an automatic cleaning device, particularly to an automatic cleaning device for cleaning suction holes of a roller.

BACKGROUND

On the production of light and soft products (such as, toilet paper, cloth, films, for example), a roller provided with several suction holes is often utilized to suck these kinds of light and soft products. Moreover, these light and soft products are capable of being conveyed successfully and then to be processed on the production line by means of the rotation of the roller.

Dust in air or dust generated from the materials of these kinds of light and soft products themselves may be sucked into the suction holes of the roller one after another, while the products are sucked by the suction holes. In the suction holes, after a period of time, dirt accumulated with dust may be aggregated, and then block is likely to be generated. The capability of suction of the roller may be reduced so as to affect the conveying of products, on the condition of the occurrence of block in a part of the suction hole.

In the past, backwashing (or referred to as positive pressure wash) is utilized to wash the suction holes for avoiding the generation of block in the suction holes. In backwashing, air is poured into the interior of the roller to blow dirt away together with the air source through the suction holes, such that the block of dirt in the suction holes is avoided.

When backwashing is utilized for washing the suction holes of the roller, however, there often exist problems as follows:

(1) It is probable to blow dirt accumulated in the apertures of the suction holes away completely by means of backwashing if the suction hole is not blocked entirely yet. Nevertheless, it is ultimately impossible to blow dirt accumulated in the suction holes away by means of backwashing if the block in the suction holes is serious. In this case, slowly pricking each suction hole one after another with a sharp needle manually is only way for cleaning. Thus, inspection and cleaning should be laborious and time-consuming.

(2) The roller must be shut down when backwashing is used for washing the suction holes. Moreover, the roller must be shut down frequently for maintenance and cleaning, which results in an increased downtime of production line and thus a reduced production efficiency, correspondingly, so as to avoid the situation of serious block resulted from too much dirt accumulated in the suction holes.

(3) If the suction holes of the roller are cleaned by means of backwashing, dirt blown away from the suction holes may be scattered over the equipment or working platform and then should be cleaned in a laborious and time-consuming way, leading to bother in maintenance.

SUMMARY OF THE INVENTION

It is one object of the present invention to provide an automatic cleaning device, comprising at least one blowing device, used for cleaning suction holes of a roller by air blowing, capable of not only blowing dust or dirt in the suction holes of the roller away effectively so as to keep the suction holes clean and ventilated all the time, but also cleaning the suction holes by air blowing without the need for shutting down the roller so as to avoid the shutdown of roller to effect the production efficiency of product.

It is one object of the present invention to provide an automatic cleaning device, in which the blowing device is mounted on a moving means, in such a way that the blowing device is capable of being moved alongside the face of the roller under the manipulation of the moving device so as to clean each suction hole by air blowing one after another.

It is one object of the present invention to provide an automatic cleaning device, in which a suction device is further provided around the periphery of the blowing device, in such a way that the automatic cleaning device is allowed to clean the suction holes by air blowing and by air sucking via the blowing device and the suction device, so as to keep the suction holes of the roller in a better unobstructed condition.

To achieve above objects, the present invention provides an automatic cleaning device, comprising one or more blowing devices, provided alongside a face of a roller having several suction holes, for cleaning the suction holes of the roller by air blowing.

In one embodiment of the present invention, further comprising a moving means, the blowing device being provided on the moving means, the blowing device being allowed to move alongside the face of the roller under the manipulation of the moving means, so as to clean each of the suction holes of the roller in succession one after another by air blowing.

In one embodiment of the present invention, wherein the moving means comprises: a slide rail, wherein the blowing device is fixed on a fixing seat and then mounted on the slide rail via the fixing seat; at least two pulleys; a belt, provided around a rim of the pulley and joined with the fixing seat; and at least one servo motor, fixedly provided on a shaft of the pulley, used to manipulate the rotation of the pulley, such that the blowing device is carried by the belt to slide on the slide rail, and the blowing device is then moved.

In one embodiment of the present invention, wherein the blowing device has been operated for a predetermined blowing duration with respect to one of the suction holes every time, the blowing device is manipulated by the servo motor to move toward the next suction hole subsequently, so as to clean the next suction hole by air blowing.

In one embodiment of the present invention, further comprising a fixing platform provided alongside the face of the roller, wherein a plurality of the blowing devices are provided on the fixing platform, each of the blowing devices is allowed to clean corresponding one of the suction holes, respectively, by air blowing.

In one embodiment of the present invention, further comprising one or more suction devices, the suction devices being provided around the periphery of the blowing device, so as to clean the suction holes and/or the face of the roller by air suction.

DETAILED DESCRIPTION

Figure 1:
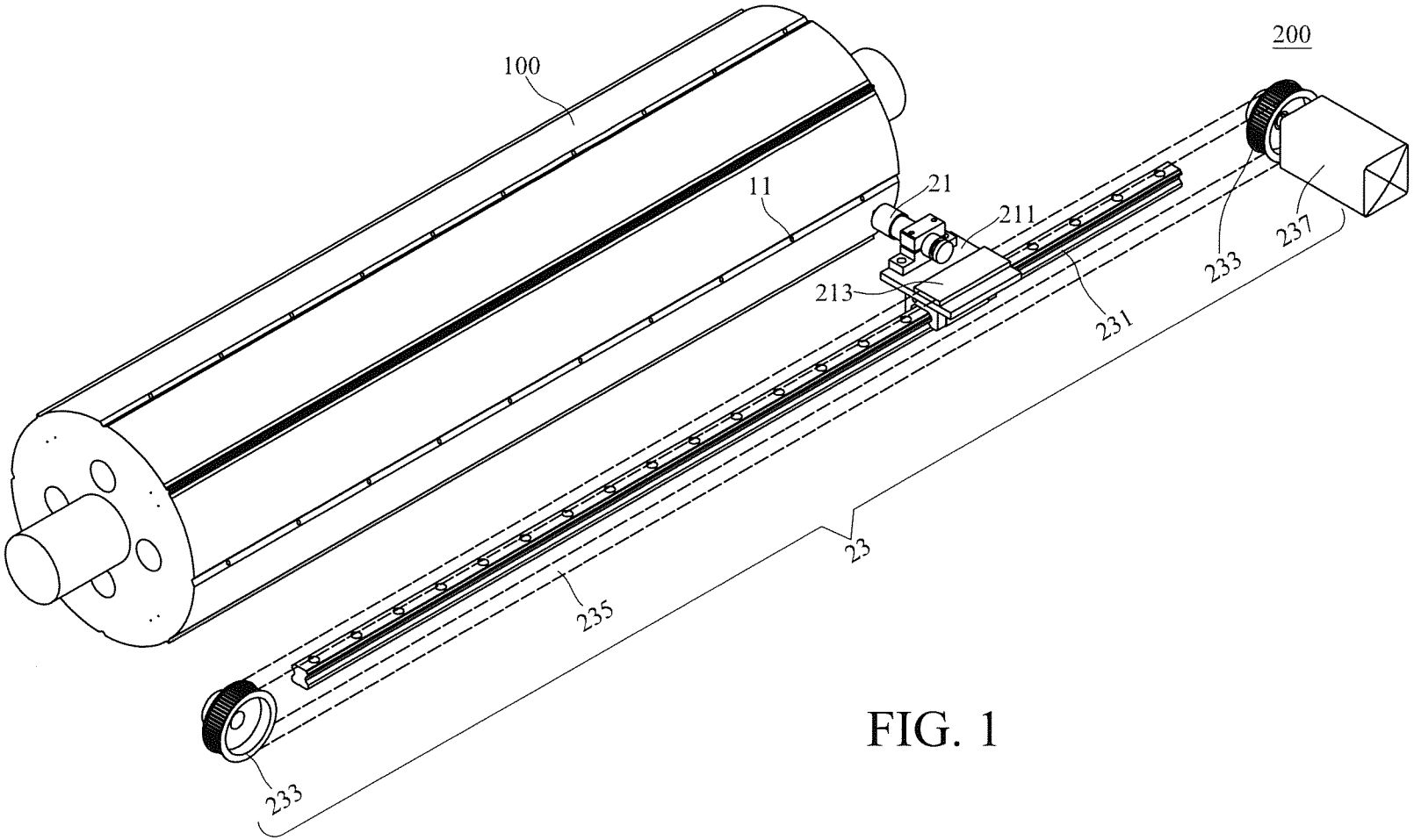
FIG. 1 is a structural perspective view of an automatic cleaning device for cleaning suction holes of a roller according to one preferred embodiment of the present invention.
Figure 2:
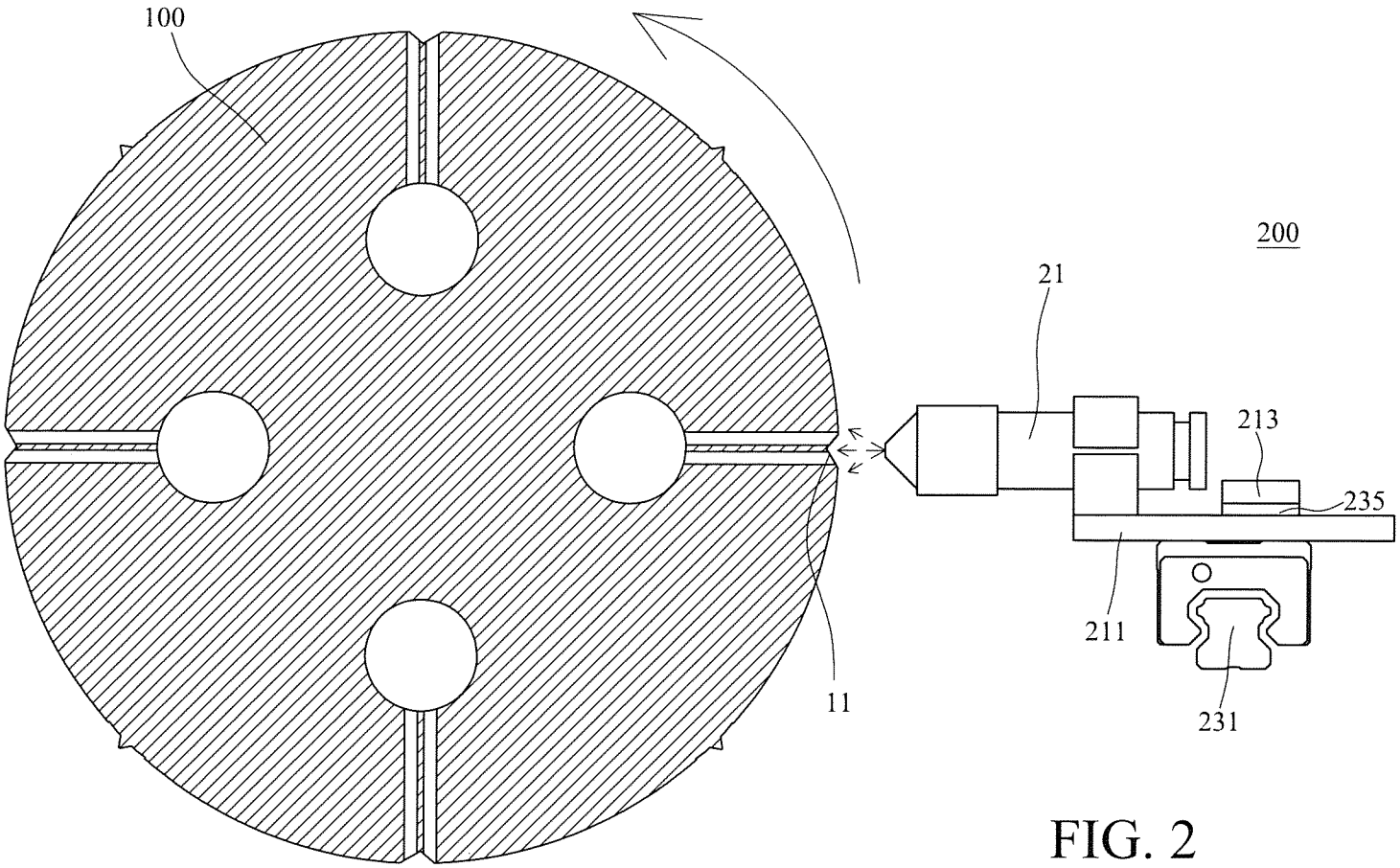
FIG. 2 is a structural cross-section view of the automatic cleaning device for cleaning suction holes of the roller according to one preferred embodiment of the present invention.

Referring to FIGS. 1, 2 and 3(A)-(C), there are shown a structural perspective view and a structural cross-section view of an automatic cleaning device for cleaning suction holes of a roller according to one preferred embodiment of the present invention, as well as a structural perspective view of a blowing device moving alongside the face of the roller of the present invention. As illustrated in the figures, an automatic cleaning device 200 of the present invention is used for cleaning a roller 100 having a plurality of suction holes 11. The suction holes 11 on the face of the roller 100 are used by the roller 100 to suck the light and soft product (such as, toilet paper, cloth and films, for example), and the product sucked onto the roller 100 may be then conveyed successfully via the rotation of the roller 100 to be processed on the production line. Moreover, the apertures of the suction holes 11 of the roller 100 are all adhered with some dust or dirt, while the suction is performed.

The automatic cleaning device 200 of the present invention comprises a blowing device 21 provided alongside the face of the roller 100. While the roller 100 is rotated, the blowing device 21 is simultaneously operated to clean each suction hole 11 on the face of the roller 100 by air blowing one after another, so as to blow dust or dirt adhered to the aperture of each suction hole 11 away.

Figure 3:
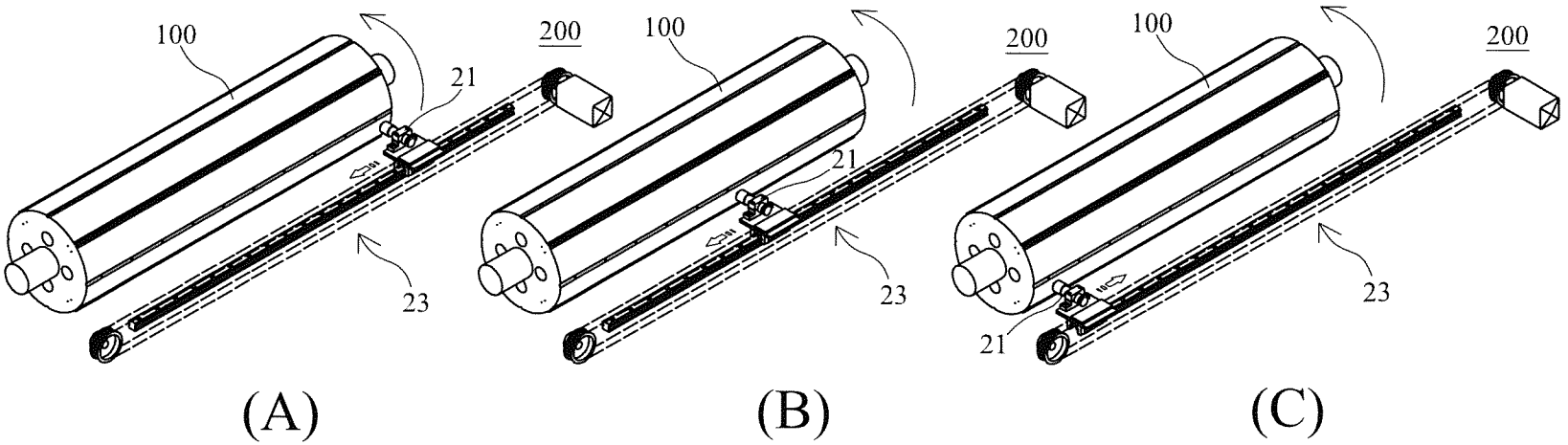
FIGS. 3 (A)-(C) are structural perspective views of a blowing device moving alongside the face of the roller of the present invention.

Furthermore, the automatic cleaning device 200 of the present invention further comprises a moving means 23, and the blowing device 21 is mounted on the moving means 23. The blowing device 21 may be moved alongside the face of the roller 100 by the manipulation of the moving means 23. As illustrated in FIGS. 3(A)-(C), the blowing device 21 is manipulated by the moving means 23 so as to move to the left alongside the face of the roller 100, and then move back to the right when the position of the last suction hole 11 is reached. Thus, the blowing device 21 is allowed to move to the position of each suction hole 11 in succession, and then, operated to clean each suction hole 11 by air blowing one after another due to this repeated motion.

In one embodiment of the present invention, the detailed construction of the moving means 23 comprises a slide rail 231, at least two pulleys 233, a belt 235 and at least one servo motor 237. The blowing device 21 is fixed on a fixing seat 211, and then mounted on the slide rail 231 via the fixing seat 211. The belt 235 is provided around the rim of the pulley 233, and joined with the fixing seat 211 via a pressure plate 213. The servo motor 237 is fixedly provided on a shaft of the pulley 233. When the blowing device 21 is desired to move, the servo motor 237 is allowed to manipulate the rotation of the pulley 233, followed by rotating the belt 235, provided around the pulley 233, together with the pulley 233. The blowing device 21 is carried by the rotating belt 235 to slidingly move on the slide rail 231, in such a way that the blowing device 21 may be moved successfully.

Although a predetermined group of members is used as the above-mentioned moving means 23 of the present invention, it should be also appreciated by those skilled in the art that each member in this group may be replaced, changed or varied readily. For instance, a ball screw rod or a linear screw rod is used instead of the belt 235, in such a way that the blowing device 21 is carried by the ball screw rod or the linear screw rod to slide on the slide rail 231. In other words, the detailed construction of the above-mentioned moving means 23 is only one of the embodiments of the present invention. It should be also understood by those skilled in the art that any related means enabling the blowing device 21 to move alongside the face of the roller 100 should be included in the scope of protection of patent claimed by the present invention.

Furthermore, a predetermined blowing duration is set for each suction hole 11 in the automatic cleaning device 200 of the present invention. Once the blowing device 21 has been operated for the predetermined blowing duration with respect to one of the suction holes 11, the automatic cleaning device 200 is allowed to manipulate the blowing device 21 to move toward next suction hole 11 subsequently, and then, clean the next suction hole 11 by air blowing. In this case, the blowing device 21 is allowed to move to the position of each suction hole 11 so as to clean each suction hole 11 periodically by air blowing through the setting of blowing duration.

Figure 4:
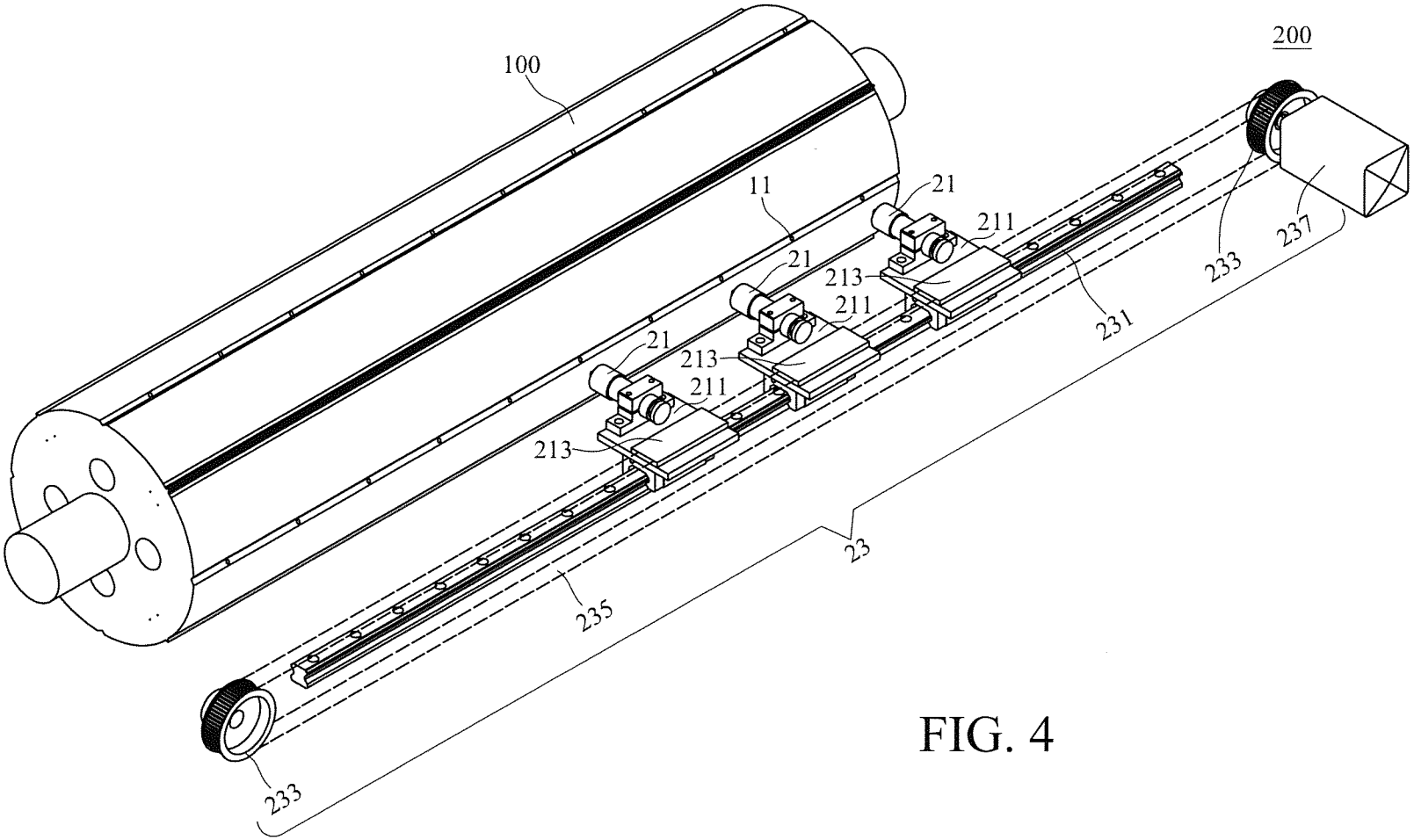
FIG. 4 is a structural perspective view of an automatic cleaning device for cleaning suction holes of a roller according to another embodiment of the present invention.

Referring to FIG. 4, there is shown a structural perspective view of an automatic cleaning device for cleaning suction holes of a roller according to another embodiment of the present invention. As illustrated in the figure, the automatic cleaning device 200 of this embodiment may be also further provided with several blowing devices 21. The duration for cleaning each suction hole 11 by air cleaning may be increased owing to the several blowing devices 21, in such a way that each suction hole 11 is kept in a better unobstructed condition all the time.

Figure 5:
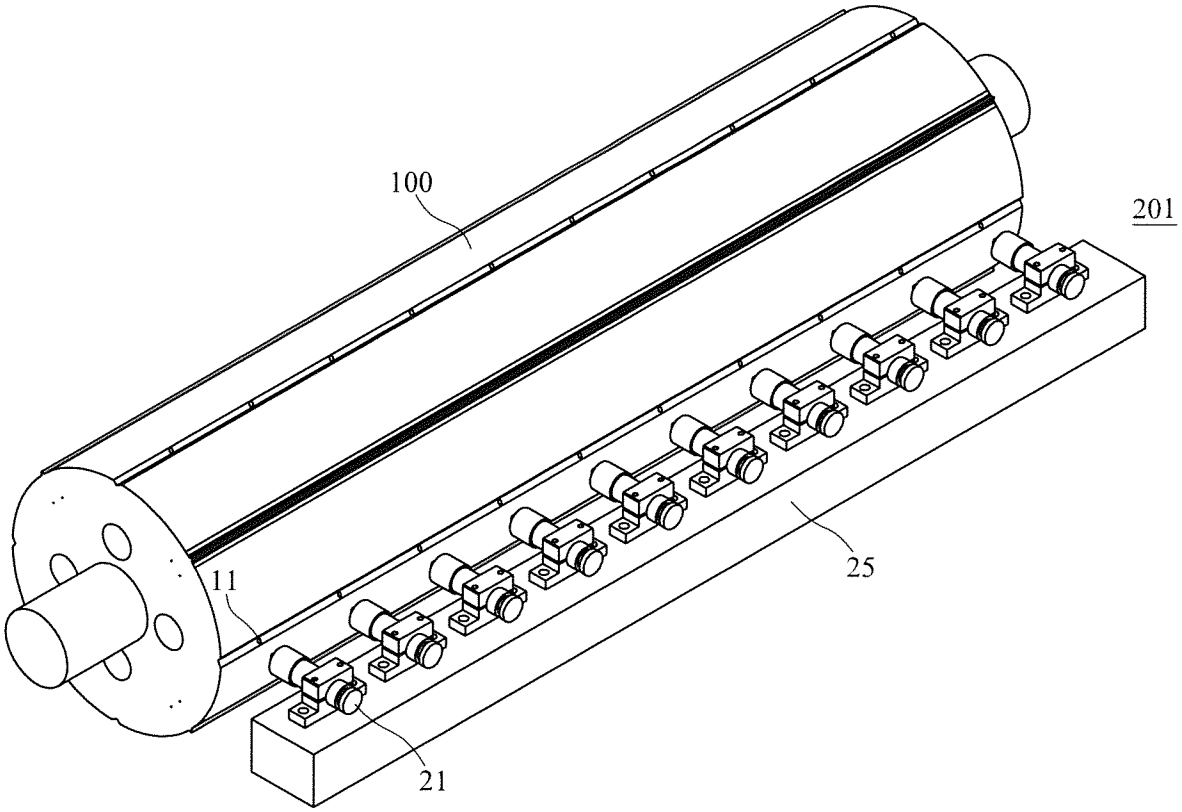
FIG. 5 is a structural perspective view of an automatic cleaning device for cleaning suction holes of a roller according to yet another embodiment of the present invention.
Figure 6:
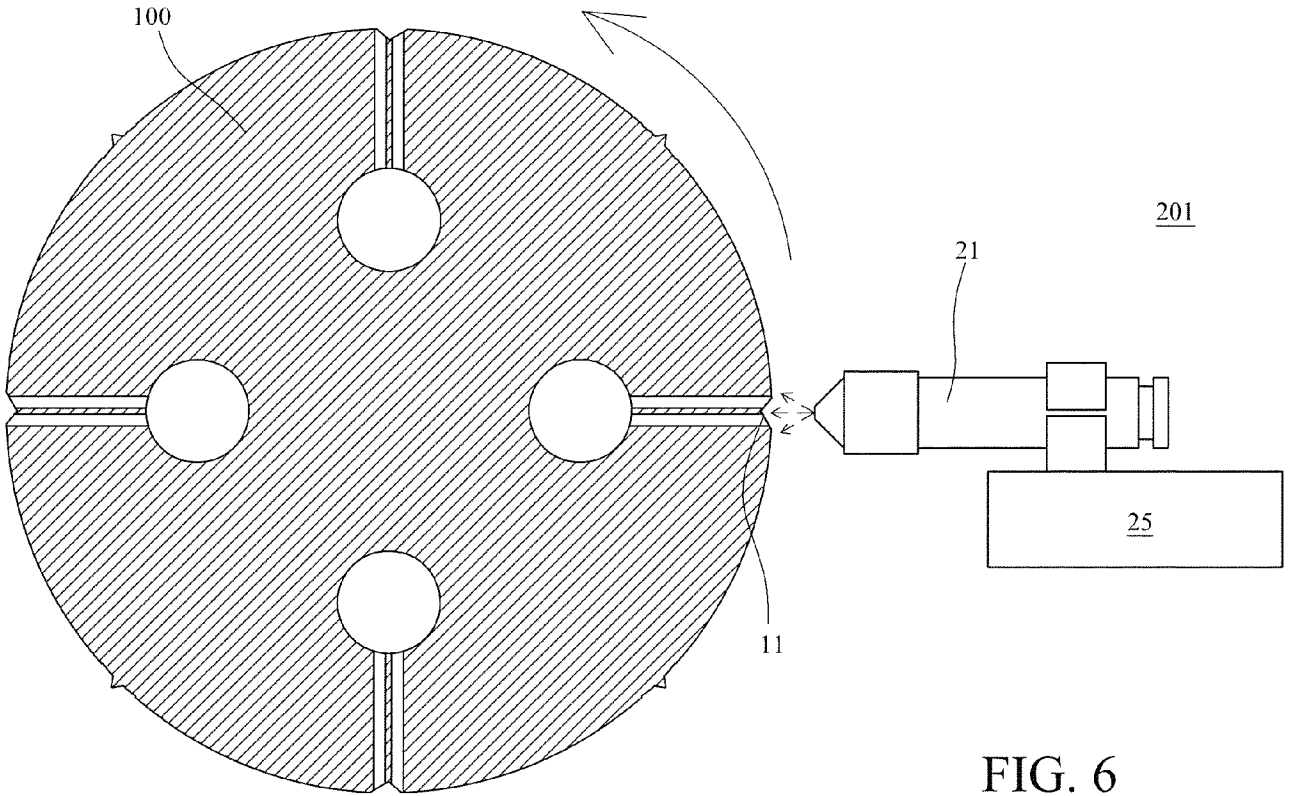
FIG. 6 is a structural cross-section view of the automatic cleaning device for cleaning suction holes of the roller according to yet another embodiment of the present invention.

Referring to FIGS. 5 and 6, there are shown a structural perspective view and a structural cross-section view of an automatic cleaning device for cleaning suction holes of a roller according to yet another embodiment of the present invention. In the automatic cleaning device 200 of above-mentioned embodiment, the blowing device 21 is mounted on the moving means 23, and then, moved alongside the face of the roller 100 under the manipulation of the moving means 23. On the contrary, in the automatic cleaning device 201 of the present embodiment, each blowing device 21 is fixedly provided on a fixing platform 25 without moving alongside the face of the roller 100. Moreover, the position of each suction hole 11 may be individually arranged a corresponding blowing device 21. As such, it is also possible to clean each suction hole 11 by air blowing.

Figure 7:
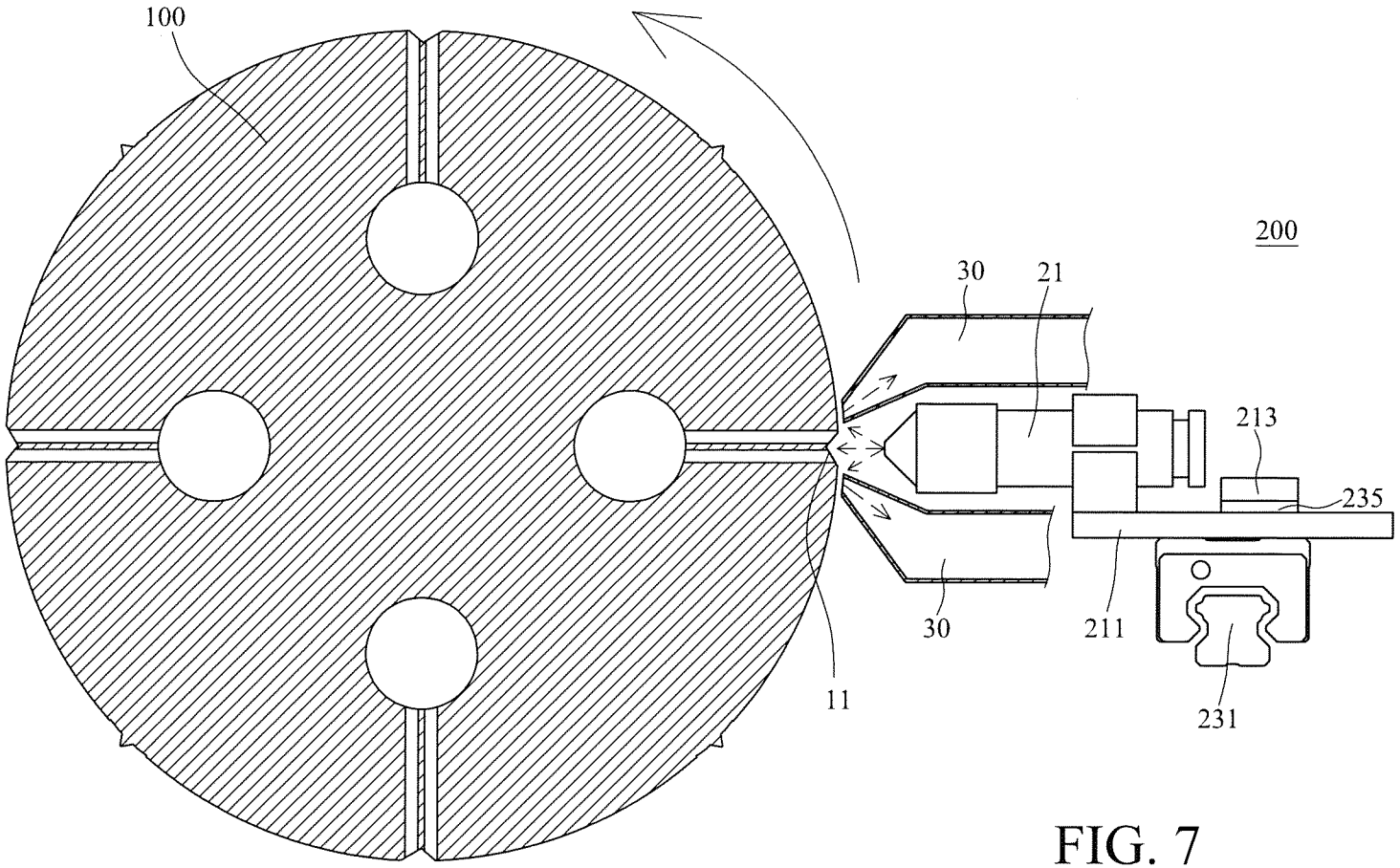
FIG. 7 is a structural cross-section view of an automatic cleaning device for cleaning suction holes of a roller according to yet another embodiment of the present invention.

Referring to FIG. 7, there is shown a structural cross-section view of an automatic cleaning device for cleaning suction holes of a roller according to yet another embodiment of the present invention. As illustrated in the figure, the automatic cleaning device 200 of the present invention further comprises one or more suction devices 30. The suction devices 30 are provided around the periphery of the blowing device 21.

When the roller 100 is rotated, the suction hole 11 of the roller 100 is rotated to the position alongside the suction device 30 firstly, in such a way that some dust or dirt adhered to the aperture of each suction hole 11 may be sucked away by air sucking of the suction device 30. Subsequently, the suction hole 11 of the roller 100 is rotated to the position alongside the blowing device 21, in such a way that residual dust or dirt adhered to the aperture of each suction hole 11 may be further blown away under the air blowing of the blowing device 21. Thereby, each suction hole 11 may be kept in a better unobstructed condition due to cyclic air sucking and blowing acted upon the suction hole 11.

Additionally, besides dust or dirt adhered to the aperture of each suction hole 11, dust or dirt blown away by the blowing device 21 may be also sucked away by the suction device 30, so as to avoid the dust or dirt blown away by the blowing device 21 adhered to the face of the roller 100, thus keeping the face of the roller 100 clean.

Figure 8:
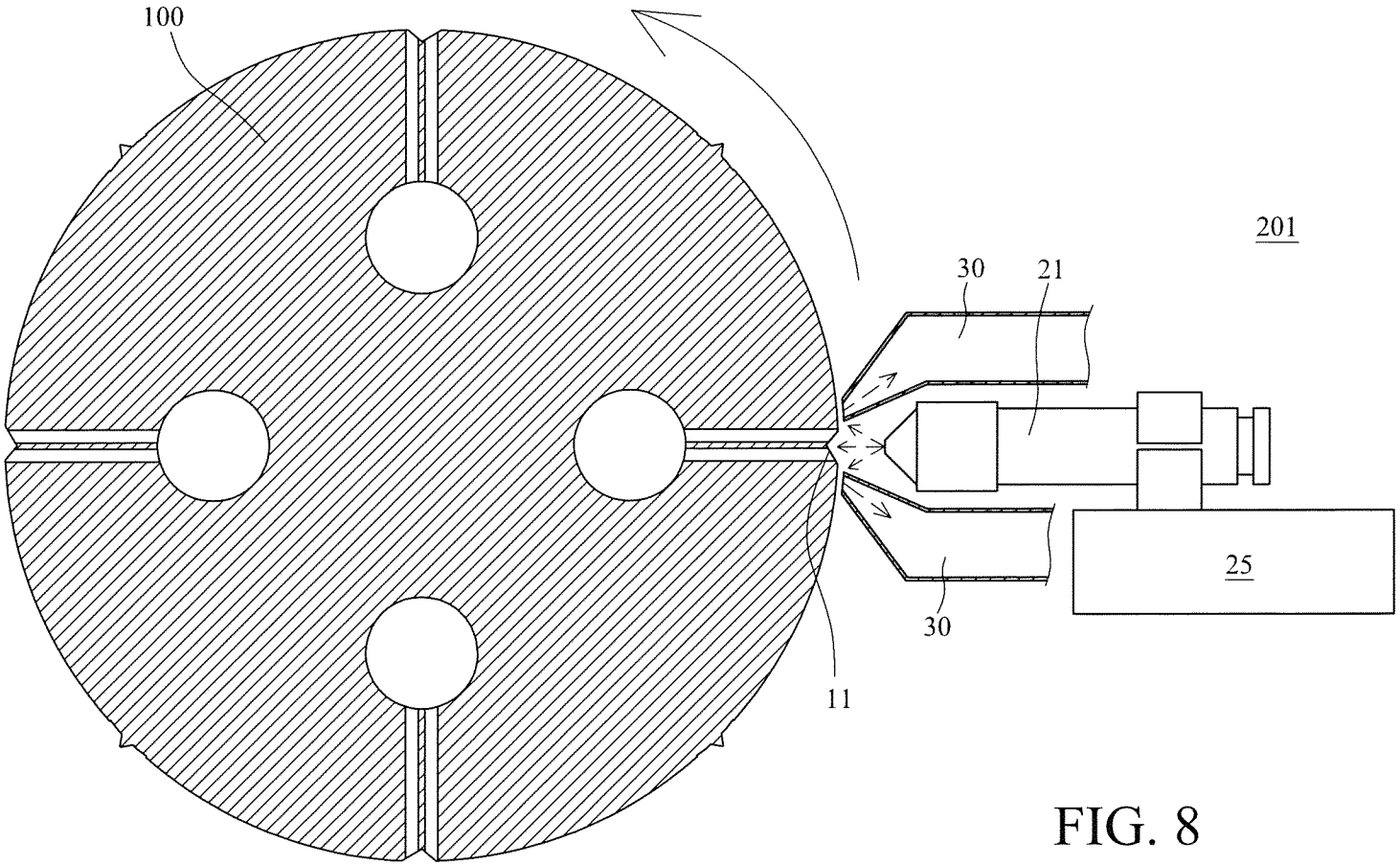
FIG. 8 is a structural cross-section view of an automatic cleaning device for cleaning suction holes of a roller according to yet another embodiment of the present invention.

As illustrated in FIG. 8, in the same way, the automatic cleaning device 201 according to another embodiment of the present invention may be additionally provided with the suction device 30 similarly. Therefore, air sucking provided by the suction device 30 as well as air blowing provided by the blowing device 21 are used by the automatic cleaning device 201 to keep each suction hole 11 in a better unobstructed condition all the time.

To sum up, the blowing device 21 and/or the suction device 30 may be used by the automatic cleaning device 200/201 to clean the suction holes 11 of the roller 100 by air blowing and/or sucking, capable of not only blowing and/or sucking dust or dirt in the suction holes 11 of the roller 100 away effectively so as to keep the suction holes 11 clean and ventilated all the time, but also cleaning the suction holes 11 by air blowing and/or sucking without the need for shutting down the roller 100 so as to avoid the shutdown of roller 100 to effect the production efficiency of product.

The present invention is not limited to the above-described embodiments. Various alternatives, modifications and equivalents may be used. Therefore, the above embodiments should not be taken as limiting the scope of the invention, which is defined by the appending claims.

The invention claimed is:

1. An automatic cleaning device, comprising:

one or more blowing devices, provided alongside an outer face of a roller having several suction holes, for cleaning said suction holes of said roller by blowing air into said suction holes;

a moving means, said one or more blowing devices being provided on said moving means and adapted to move alongside said face of said roller under the manipulation of said moving means, so as to clean each of said suction holes of said roller in succession one after another by blowing air into said suction holes; and one or more suction devices, said suction devices being provided around the periphery of each of said blowing devices, so as to clean said suction holes and/or said face of said roller by air suction.

2. The automatic cleaning device according to claim 1, wherein said moving means comprises:

a slide rail, wherein each of said one or more blowing devices is fixed on a fixing seat and then mounted on said slide rail via said fixing seat;

at least two pulleys;

a belt, provided around a rim of said pulley and joined with said fixing seat; and at least one servo motor, fixedly provided on a shaft of said pulley, used to manipulate the rotation of said pulley, such that each of said one or more blowing devices is carried by said belt to slide on said slide rail, and each of said one or more blowing devices is then moved.

3. The automatic cleaning device according to claim 2, wherein once each of said blowing devices has been operated for a predetermined blowing duration with respect to one of said suction holes, each of said blowing devices is manipulated by said servo motor to move toward said next suction hole subsequently, so as to clean said next suction hole by blowing air.

4. An automatic cleaning device, comprising: a plurality of blowing devices, provided alongside an outer face of a roller having several suction holes, for cleaning said suction holes of said roller by blowing air into said suction holes, further comprising a fixing platform provided alongside said face of said roller, wherein said plurality of blowing devices are provided on said fixing platform, each of said blowing devices being adapted to clean one of a corresponding suction hole on said roller, respectively, by blowing air, and one or more suction devices, said suction devices being provided around the periphery of each of said blowing devices, so as to clean said suction holes and/or said face of said roller by air suction.

* * * * *